US005180101A

United States Patent [19]

Thompson

[11] Patent Number: 5,180,101

[45] Date of Patent: Jan. 19, 1993

[54] NEWSPAPER ALERT APPARATUS

[76] Inventor: Christopher H. Thompson, 240 Georgetown Rd., Weston, Conn. 06833

[21] Appl. No.: 837,808

[22] Filed: Feb. 18, 1992

[51] Int. Cl.[5] ..... B65D 91/00

[52] U.S. Cl. ..... 232/34; 232/1 C

[58] Field of Search ..... 232/1 C, 17, 34

[56] References Cited

U.S. PATENT DOCUMENTS

| | | | |
|---|---|---|---|
| 1,904,448 | 4/1933 | Hampden et al. | 232/1 C |
| 2,496,962 | 2/1950 | Shaw | 232/34 |
| 2,553,164 | 5/1951 | Bishop | 232/34 |
| 3,275,228 | 9/1966 | Golla . | |
| 3,602,424 | 8/1971 | Raulston | 232/35 |
| 4,007,870 | 3/1977 | Hankis | 232/34 |
| 4,181,250 | 1/1980 | Withrow . | |
| 4,308,989 | 1/1982 | Elsinger | 232/1 C |
| 4,437,607 | 3/1984 | Negosta | 232/35 |
| 4,454,981 | 1/1984 | Halmasy, Sr. | 232/34 |
| 4,721,244 | 1/1988 | Armstrong | 232/34 |
| 4,923,114 | 4/1990 | Fiske, Jr. | 232/34 |
| 4,995,330 | 2/1991 | Likens | 232/34 |

*Primary Examiner*—Renee S. Luebke
*Assistant Examiner*—Michael J. Milano
*Attorney, Agent, or Firm*—McAulay Fisher Nissen Goldberg & Kiel

[57] ABSTRACT

A newspaper box has a newspaper delivery indicating device comprising a flag, flap and hinge which pass through a slot in a top wall of a newspaper container. At least two additional holes are provided through which a pair of wire loops extend for supporting the hinge. The hinge is either a shaft extending perpendicular to a pair of arms from which the flag and flap extend, or a pair of holes in the flap itself. In operation, a newspaper inserted within the box drives the flap inwardly and cause the flag to rise. Preferably, the device is produced as a unitary structure to allow utilizing the invention as a low cost kit for retro-fitting to existing newspaper boxes. Utilizing such a device provides ease in indicating when a newspaper has been delivered while minimizing the cost of retro-fitting existing newspaper boxes.

8 Claims, 3 Drawing Sheets

NEWSPAPER ALERT APPARATUS

TECHNICAL FIELD

This invention relates to newspaper delivery boxes and more particularly to a delivery box with means for indicating when a newspaper has been delivered.

BACKGROUND

Newspapers are typically delivered along a route by placing the newspaper in an open ended container located by a roadway. The use of such a local container is convenient for the route delivery person and provides a safe sheltered location for the newspaper until picked up by the newspaper customer. However, unless the delivery of the paper is actually seen, there is no way to tell whether the paper has been delivered. Consequently, frequent walks to the delivery box may be required to determine if the paper has been received.

In U.S. Pat. No. 4,721,244, a device for signaling the delivery of mail or newspapers in an enclosed receptacle that is open on at least one end is described. The device comprises a trigger element that blocks a portion of the delivery opening of the receptacle and a flag element that signals the delivery. These elements operatively slidably engage one another to cause displacement.

In U.S. Pat. No. 4,007,870, a signal for mounting upon a conventional newspaper delivery box is disclosed which comprises a molded clamp unit which releasably clamps upon the upper edge of the open forward end of the box with a flap arranged within and blocking the box opening. The flap pivots upwardly upon insertion of the newspaper within the box. A signal flag connected to the flap swings into an upright signaling position. The flap and flag are separate parts which are secured to the separate clamp and to each other to form the signal unit.

While such devices in some respects are useful, the search continues for alternative means for providing a newspaper delivery box signal which is of low cost and which may be retofitted to existing newspaper boxes.

SUMMARY OF THE INVENTION

It is an object of the present invention to provide a newspaper delivery box having means to indicate that a newspaper has been delivered.

It is a further object to provide a unitary device for indicating delivery of a newspaper which is simple in construction and is easily adapted to conventional newspaper boxes.

It is a further object to provide means for adapting the signaling device to existing newspaper boxes.

These and other objects of the present invention are achieved by providing a newspaper box comprising a container having an open end, the container having a top wall, a pair of openings in the top wall, a slot disposed adjacent to the openings, a hinge in the form of a shaft disposed in the slot, a pair of supports extended through the openings and slot for supporting the hinge, a flap extending from the hinge into the opening and a flag extending from the hinge at a right angle to the flap, the flag resting on top of the top wall. Such a device requires only three parts, two hinge supports and the integral flap/flag structure.

Utilizing a unitary hinge-flap-flag member supported on a pair of supports provides a simple means for indicating when a newspaper has been delivered. As the paper is inserted into the box, the flap is rotated inwardly into the container, causing the flag to rise. This gives a clear visual indication that the paper has been delivered.

BRIEF DESCRIPTIONS OF THE DRAWINGS

DETAILED DESCRIPTION OF THE INVENTION

Figure 1:
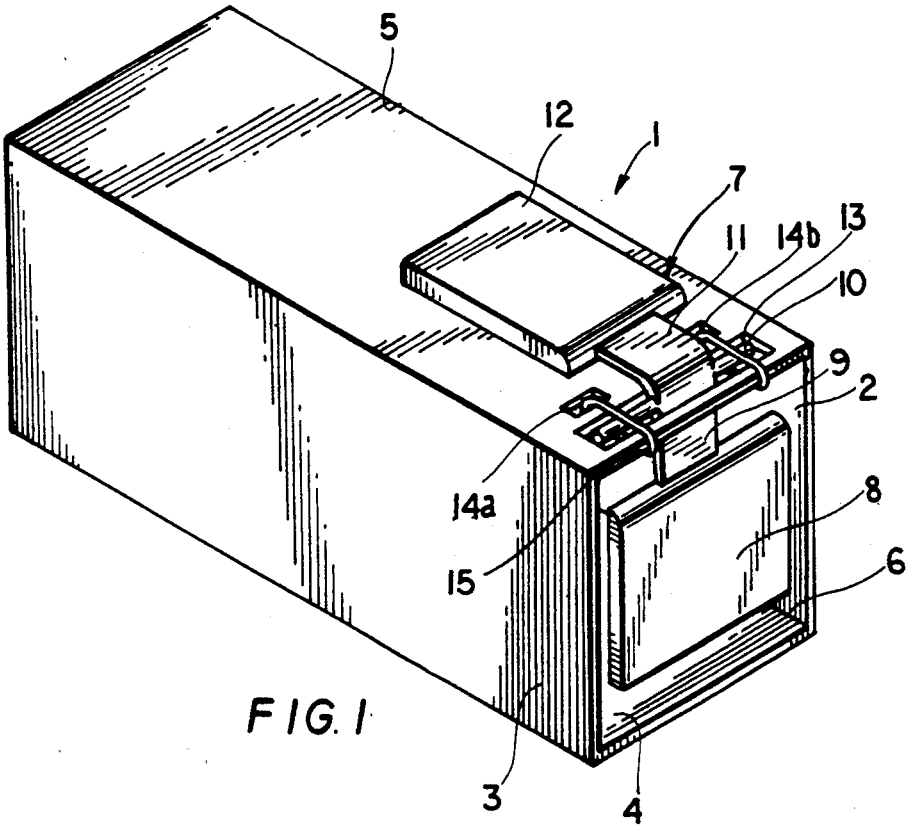
FIG. 1 is a perspective view of the paper alert of the present invention.

Referring to FIG. 1, a newspaper box 1, has sides 2 and 3, a bottom 4 and a top 5. The box also has a front opening 6 through which a newspaper is inserted into the container. Such a box is usually composed of plastic but may also be made of other materials.

A delivery indication device 7 is located at the front end of the container. The device has a flap 8 connected integrally through a portion 9 to a shaft 10 which acts as a hinge. An arm 11 extends integrally from the hinge at a right angle to the flap and connects to a flag 12.

The container has a longitudinal slot 13 through which the arm 11 extends. A pair of holes 14*a* and 14*b* are disposed adjacent to the slot and parallel thereto. A pair of supports 15 pass through the holes and around the shaft and support the shaft for rotation. Such supports in this embodiment comprise wires which loop through the openings and slot.

Figure 2:
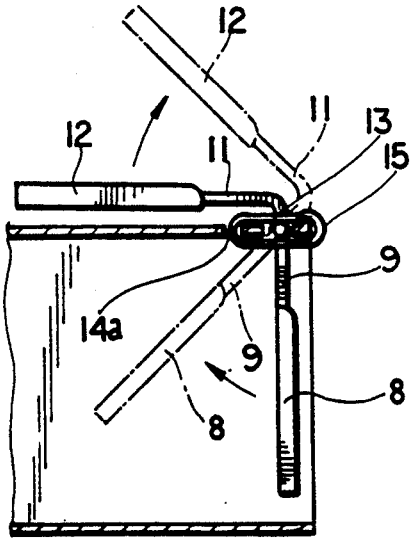
FIG. 2 is a side cross-sectional view of the paper alert device of FIG. 1.
Figure 3:
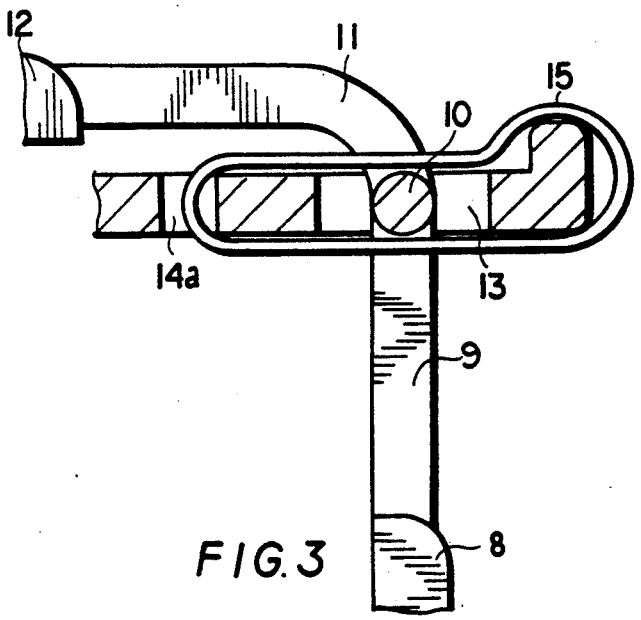
FIG. 3 is an enlarged view of the paper alert device of FIG. 1.

Referring to FIG. 2, the box of FIG. 1 is shown in cross-section. The shaft 10 is supported by the hinge support 15. When empty, the weight of the flag 12 holds the flap in the closed position. Preferably, the flag is of a highly visible color such as red or has a luminescent character to enhance visibility. When a newspaper is inserted, the flap moves inwardly, as shown in phantom, raising the flag. FIG. 3 shows this embodiment in an enlarged side view.

Figure 4:
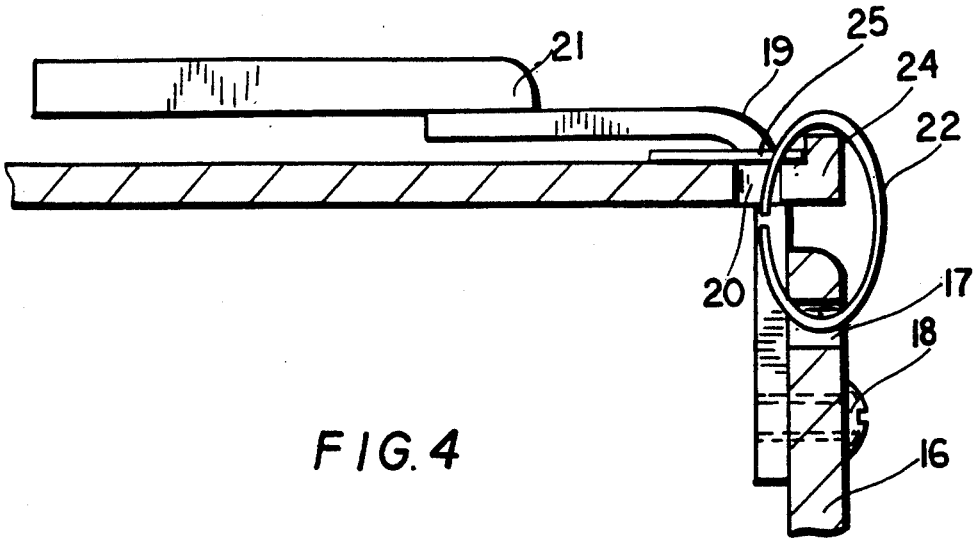
FIG. 4 is an enlarged side view of an alternative paper alert device of the invention.
Figure 5:
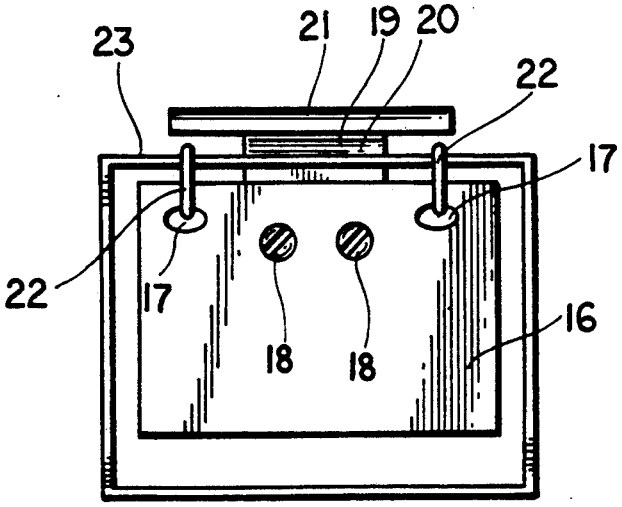
FIG. 5 is a front view of the device of FIG. 4.
Figure 6:
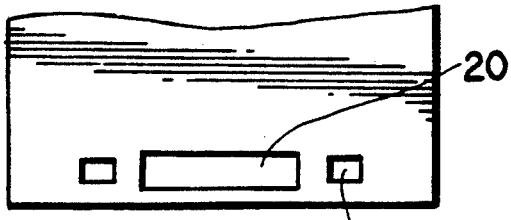
FIG. 6 is a top view of the box shown in FIG. 4.

Referring to FIGS. 4 and 5 an alternative embodiment of the invention is shown. In this embodiment, a flap 16 has a pair of holes 17 in an upper end thereof. The flap is attached by a screw 18 to a right angle bracket 19 which passes through a slot 20 in the top of the container. A flag 21 is similarly attached to the other end of the bracket. A pair of wires or belts 22 extend through a pair of holes 23 in the box best seen in FIG. 6, through the holes 17 and around a front lip 24 of the box. Since the wires or belts are flexible, the bracket will ride against the lip during rotation upon newspaper insertion. Preferably, a skirt 25 surrounds the bracket adjacent the slot 20 to keep rain out of the box. In this embodiment the holes and slot maybe in line, or the holes may be just in front of the slot.

To assemble this embodiment, the three holes are provided in the box and the bracket 19 is placed in the slot 20. The flap 16 is then attached to the bracket using the screw 18. The advantage of this embodiment is that smaller holes are made in the container yet the number of parts are still at a minimum. The flag and bracket may be unitary or pre assembled and only one screw and 2 wires completes the assembly.

In an alternative embodiment, a pair of plastic members are used which have means for accepting a hinge therein. For example, in FIG. 7, a box 30 has a top wall 31 with a pair of holes 32 therein. A front lip 33 is disposed above an opening 34 and a slot 35 is located just behind the lip. A member 36 has a top wall 37, an arm 38 extending forwardly and a "C" shaped clip 39 extending from an end of the arm. The clip has a "C" shape to allow a snap fit over a shaft 40 which acts as the hinge. The top wall 37 covers the opening 32. A pair of wedges 41 engage the edges of the hole to lock the members into position. Such members could easily be molded from a plastic material, to minimize cost. The flap/flag assembly previously described with FIG. 1, could be used in this embodiment.

Preferably, the device is made as a unitary construction, such as by molding out of plastic. However, the component construction is also useful, and the components may be made of metal or plastic. The supports shown as loops may be metal, plastic or rubber, and it is preferred that they have a degree of resilience.

Figure 7:
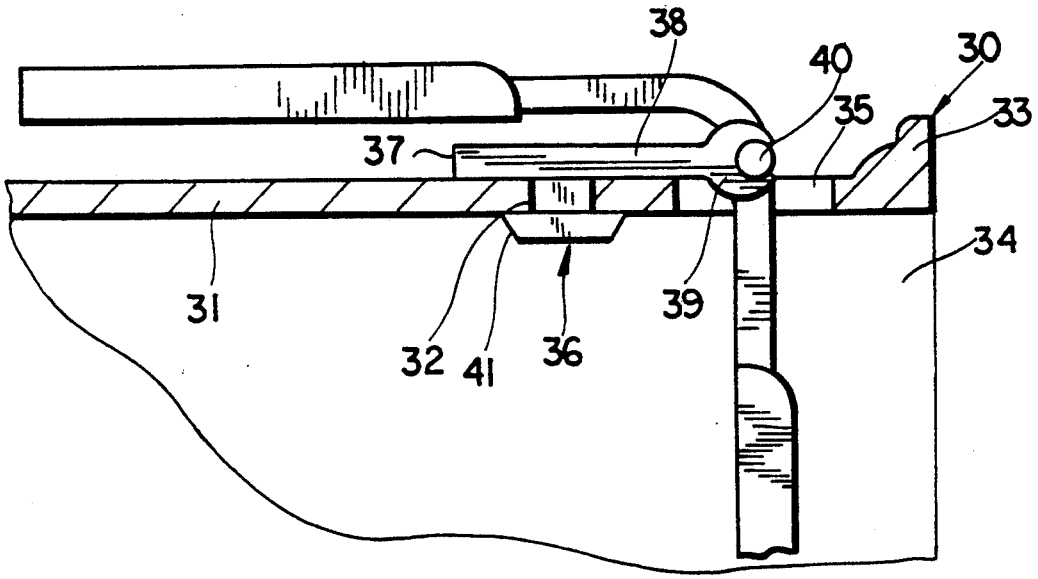
FIG. 7 is another embodiment of the paper alert device of the invention.
Figure 8:
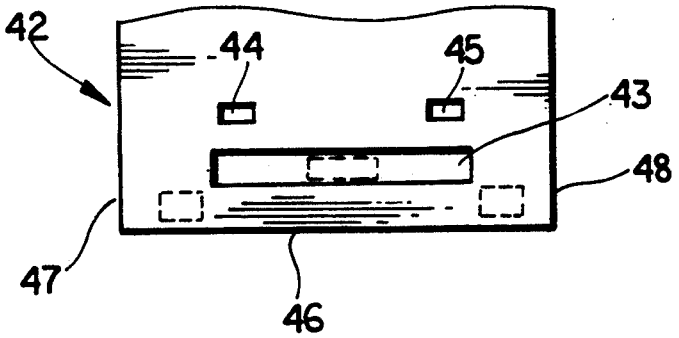
FIG. 8 is a top view of a template.

In an especially preferred embodiment, the device is prepared as a kit for retro-fitting on existing newspaper boxes to minimize cost. The kit would include the flap-flag-hinge structure, a pair of hinge supports, and a template for locating and outlining the location of the holes required. A template 42 is shown in FIG. 7, and has a slot 43 and openings 44 and 45 therein. The template is thin, and has a front edge 46 alignable with the front edge of a newspaper box. Side edges 47 and 48 align with the sides of the box to properly center the template. Shown in phantom are opening which correspond to the holes shown for the embodiment of FIGS. 4, 5, and 6.

A person would obtain the kit, align the template on the top of the container, and cut out the slot and holes. The flap would then be dropped through the slot and the supports placed through the holes for supporting the assembly. Such a kit design would allow quick and easy adaption of the invention to a conventional newspaper box.

While a preferred embodiment of the present invention has been shown and described, it will be understood by those skilled in the art that various changes and modifications could be made without varying from the scope of the present invention.

I claim:

1. A newspaper box having delivery indicating means comprising a container having a top wall, a bottom wall and a pair of side walls, and having an open forward end, the top wall having a forward edge which defines an edge of the open end, a slot provided in the top wall and extending substantially parallel to the forward edge, a pair of holes provided in the top wall, and disposed adjacent to the slot, the holes axially aligned with each other and substantially parallel to the slot, the slot disposed between the holes and the forward edge, hinge means disposed in the slot in the tip wall, a pair of wire loops extending through the holes and through open end, the hinge means contained within the loops and rotatably supported thereby, a flap integral with the hinge means and extending downwardly therefrom into the container open end and a flag extending at a right angle to the flap integral with the hinge means, the flag resting on top of the top wall when the box is empty, and in an upright position when a newspaper is placed in the box.

2. The newspaper box of claim 1 wherein the flag is rectangular and is of a highly visible color.

3. The newspaper box of claim 1 wherein the flag, flap and hinge are a unitary construction.

4. The newspaper box of claim 1 wherein the flap is sized to substantially cover the open end.

5. The newspaper box of claim 1 wherein a pair of arm portions which are narrower than the flag or flap extend form a shaft for connecting the flag and flap to the shaft.

6. The newspaper box of claim 1 wherein the hinge means comprise a pair of holes in an upper edge of the flap.

7. A newspaper box having delivery indicating means comprising a container having a top wall, a bottom wall and a pair of side walls, and having an open forward end, the top wall having a forward edge which defines an edge of the open end, a slot provided in the top wall and extending substantially parallel to the forward edge, a pair of holes provided in the top wall, and disposed adjacent to the slot, the holes axially aligned with each other and substantially parallel to the sot, the slot disposed between the holes and the forward edge, hinge means disposed in the slot in the top wall, a pair of clips disposed in the holes in the top wall, each clip has a clip wall and a forwardly extending arm which extends above the container top wall, parallel thereto, each clip having a C-shaped end sized to retain the hinge means therein with a snap fit, and having wedge means extending downwardly from the clip wall for engaging the hole for retaining the clip in the hole, the hinge means comprising a horizontally extending shaft, a flap integral with the hinge means and extending downwardly therefrom into the container open end and a flag extending at a right angel to the flap integral with the hinge means, the flag resting on top of the top wall when the box is empty and in an upright position when a newspaper is placed in the box.

8. The newspaper box of claim 7 wherein the means to retain the clip comprise wedges which engage the edges of the hole.

* * * * *